US006035486A

United States Patent [19]

McCormick

[11] Patent Number: 6,035,486

[45] **Date of Patent: *Mar. 14, 2000**

[54] DUST BAG HOUSING DOOR WITH FINAL FILTRATION COMPARTMENT

[75] Inventor: Michael J. McCormick, Danville, Ky.

[73] Assignee: Matsushita Electric Corporation of America, Danville, Ky.

[ * ] Notice: This patent is subject to a terminal disclaimer.

[21] Appl. No.: 09/244,303

[22] Filed: Feb. 3, 1999

Related U.S. Application Data

[63] Continuation of application No. 08/916,981, Aug. 14, 1997, Pat. No. 5,867,863.

[51] Int. Cl.[7] ..... A47L 5/30

[52] U.S. Cl. ..... 15/352; 15/347; 15/351

[58] Field of Search ..... 15/327.1, 344, 15/347, 350, 351, 352; 55/372, 422, DIG. 2, DIG. 3

[56] References Cited

U.S. PATENT DOCUMENTS

| | | | |
|---|---|---|---|
| 1,992,042 | 2/1935 | Rurka | 55/372 |
| 3,634,905 | 1/1972 | Boyd | 55/DIG. 2 |
| 4,202,070 | 5/1980 | Harfst . | |
| 4,443,235 | 4/1984 | Brenholdt et al. . | |
| 4,545,794 | 10/1985 | Himukai . | |
| 4,627,858 | 12/1986 | Jacob | 55/372 |
| 4,709,443 | 12/1987 | Bigley | 55/DIG. 3 |
| 4,959,885 | 10/1990 | Sovis et al. . | |
| 5,090,083 | 2/1992 | Wulff . | |
| 5,216,778 | 6/1993 | Suzuki et al. | 15/327.1 |
| 5,297,311 | 3/1994 | Puri . | |
| 5,373,607 | 12/1994 | Hwang . | |
| 5,467,502 | 11/1995 | Johnson et al. . | |
| 5,500,978 | 3/1996 | Levine . | |
| 5,500,979 | 3/1996 | Worwage . | |
| 5,690,713 | 11/1997 | Bowerman et al. . | |
| 5,961,676 | 10/1999 | King et al. | 15/347 |

FOREIGN PATENT DOCUMENTS

4240172 A1 6/1994 Germany .

*Primary Examiner*—Terrence R. Till
*Attorney, Agent, or Firm*—King and Schickle

[57] ABSTRACT

A vacuum cleaner is provided including a nozzle assembly and a handle pivotally connected to the nozzle assembly. The handle includes a cavity for holding a fan and motor assembly and a dust bag. A main door on the handle is operable to gain access to the dust bag in the cavity. A final filtration compartment is carried on the main door. The final filtration compartment includes a separate access door that is received in the front face of the main door and fits flush therewith.

6 Claims, 2 Drawing Sheets

24
26
10
14
54
22
56
52
68
30
12

DUST BAG HOUSING DOOR WITH FINAL FILTRATION COMPARTMENT

This application is a continuation of U.S. patent application Ser. No. 08/916,981 filed Aug. 14, 1997, now U.S. Pat. No. 5,867,863.

TECHNICAL FIELD

The present invention relates generally to the vacuum cleaner art and, more particularly, to a unique upright vacuum cleaner having a dust bag housing door that carries an integral final filtration compartment.

BACKGROUND OF THE INVENTION

A vacuum cleaner is an electrically powered, mechanical appliance utilized for the dry removal of dust and loose dirt from carpets, rugs, fabrics and other surfaces. Vacuum cleaners have been widely utilized for years in domestic and industrial cleaning applications.

In operation, a pressure drop is utilized to force air entrained with loose dirt and dust into the nozzle of the vacuum cleaner. The dust and dirt laden air is then drawn through a bag which traps and retains the dirt. The air is then exhausted by electric fan through an additional filter to remove relatively fine particles. It is this fan that provides the air pressure drop or vacuum that provides the cleaning action.

In recent years one focus of the vacuum cleaner industry has shifted to the establishment of improved filtration systems to remove residual dust and dirt particles not trapped by the vacuum cleaner bag. This is generally done by incorporation of a filter in the exhaust air flow pathway. One problem that has not been fully addressed to date, however, is the convenient location of the final filtration compartment on the vacuum cleaner where it may be readily accessed and cleaned.

SUMMARY OF THE INVENTION

Accordingly, it is a primary object of the present invention to provide a vacuum cleaner incorporating a conveniently located final filtration compartment that allows easy access when checking and/or changing a filter cartridge.

Still another object of the present invention is to provide a vacuum cleaner including a final filtration compartment integrally located on the main door leading to the cavity housing the dust bag and including a separate access door that may be conveniently and easily reached in order to change the final filtration cartridge.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a vacuum cleaner is provided including a housing having a cavity. A nozzle assembly is provided in fluid communication with a fan and motor assembly that is carried in the housing. A dust collector such as a bag or other vessel is held in the cavity. A main door on the housing is openable to gain access to the cavity so that the dust collector may be checked and/or changed when necessary. Additionally, a final filtration compartment is carried on that door.

More particularly describing the invention, the final filtration compartment includes an access door and a recess formed in the housing door for holding a filter cartridge. Preferably, the access door is received in a front face of the main door and fits flush therewith.

Still more specifically, the access door includes an exhaust vent providing communication between the final filtration compartment and the environment. Further, the recess of the final filtration compartment formed in the main door includes an inlet that is in fluid communication so as to receive the exhaust from the fan and motor assembly. Accordingly, it should be appreciated that dust and dirt laden air is drawn through the nozzle assembly of the vacuum cleaner by the fan and motor assembly. The dust and dirt is trapped in the dust collector held in the cavity. The relatively clean air is then drawn through the fan and motor assembly and then exhausted through the filter cartridge held in the final filtration compartment. This final filter cartridge removes from the air stream dust and dirt particles too small to be trapped by the dust collector including many allergens such as mold, pollen and dust mites.

Advantageously, the access door for the final filtration compartment is positioned on the main door at the front and near the center of the vacuum cleaner. This is a convenient location located well above ground level where it may be easily accessed. Advantageously, the filter cartridge may be replaced without opening the main door and, therefore, without disturbing the dust bag in the cavity and stirring the dust associated therewith. Further, it should be appreciated that the main door may be easily removed from the vacuum cleaner and the final filtration compartment fully cleaned without lifting the vacuum cleaner.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
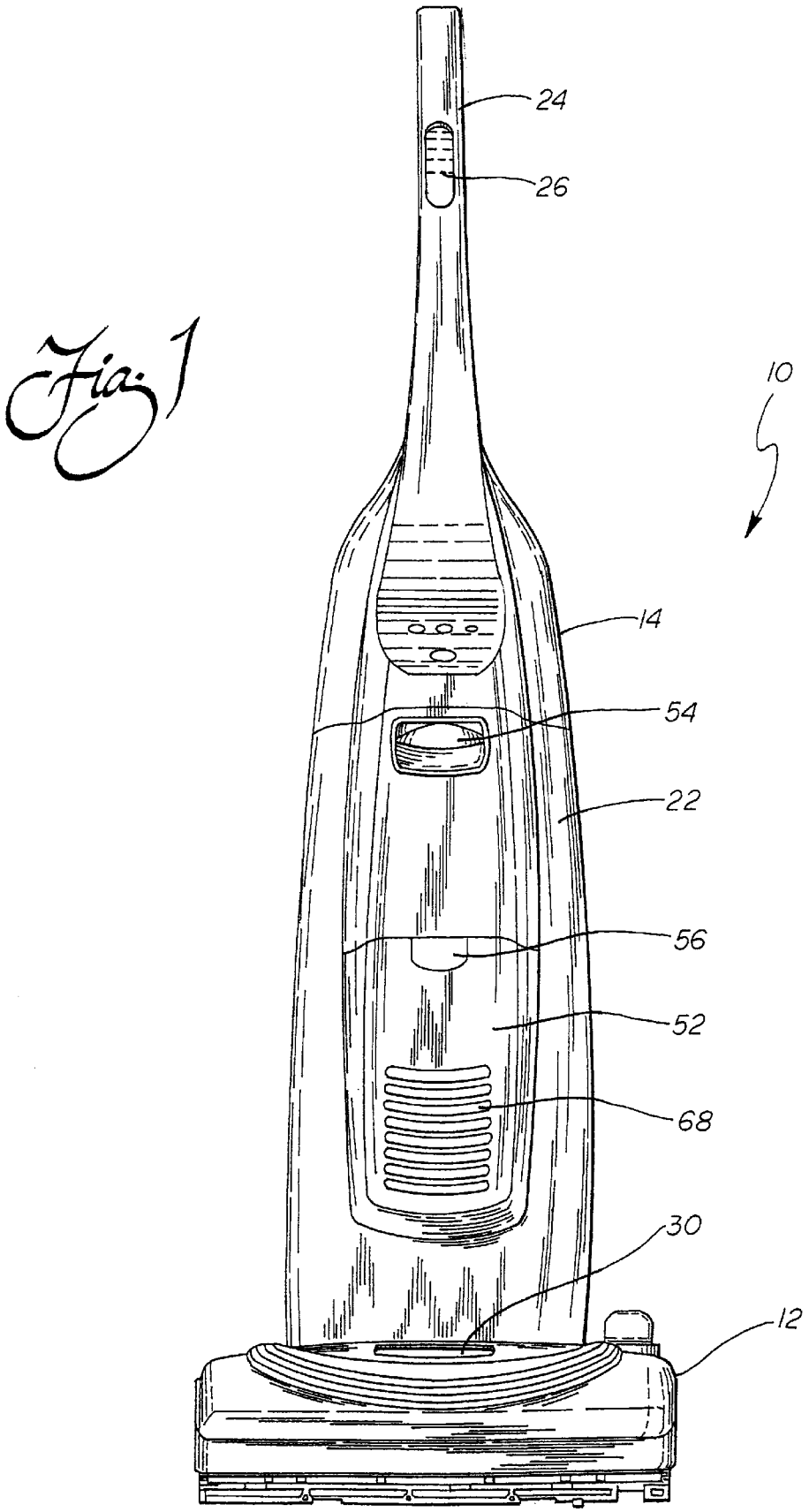
FIG. 1 is a front elevational view of a vacuum cleaner of the present invention.
Figure 2:
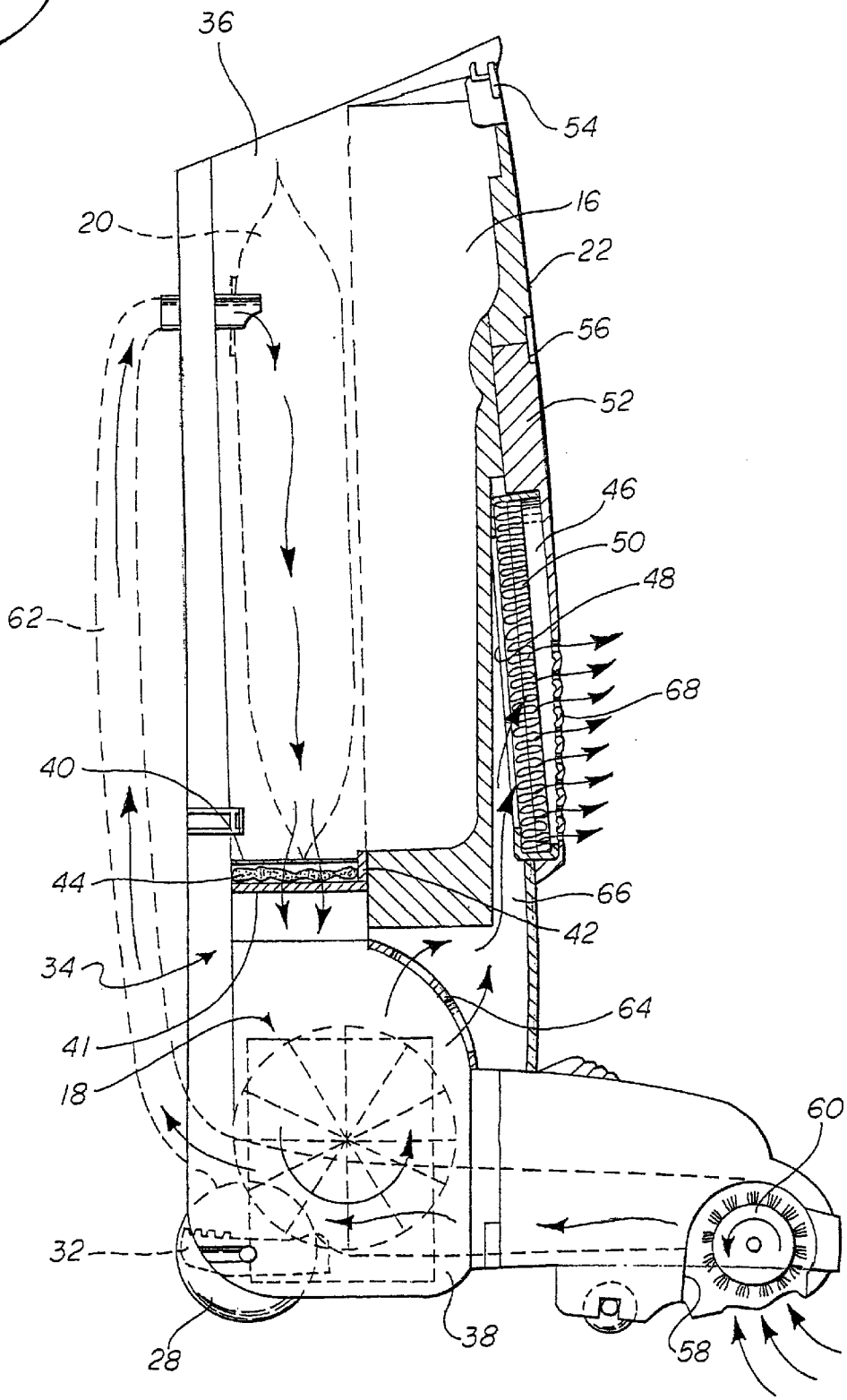
FIG. 2 is a detailed, partially cross-sectional view showing the location of the final filter compartment on the main door and demonstrating the air flow path through the vacuum cleaner.

Reference is now made to FIG. 1 showing a front elevational view of an upright vacuum cleaner 10 including a nozzle assembly 12 and a handle 14 pivotally connected to the nozzle assembly. As should be appreciated, the handle 14 includes a cavity 16 which receives a fan and motor assembly 18 and a dust collector such as a bag 20. The main door 22 closes the cavity 16. The handle 14 also includes a hand grip 24 which carries an on/off switch 26. Of course, electrical power is supplied through a cord (not shown).

A pair of rear wheels 28 are mounted for relative rotation at the lower portion of the handle 14. These rear wheels 28 are provided to support the weight of the vacuum cleaner 10. The rear wheels 28 also provide a pivot point about which the nozzle assembly 12 pivots when the height of the nozzle assembly is adjusted by the manipulation of the height adjustment switch 30. The operation of the height adjustment switch 30 and its cooperating mechanism is described in detail in U.S. Pat. No. 5,467,502 to Johnson et al, the full disclosure of which is incorporated herein by reference. Of course, as is known in the art, a foot latch 32 locks the handle 14 in an upright position as shown in FIG. 1 in order to allow storage and "off-the-floor" cleaning. When the foot latch 32 is released, the handle 14 may be pivoted relative to the nozzle assembly 12 in a manner well known in the art so as to allow an individual to manipulate and direct the vacuum cleaner 10 as desired.

In order to provide the most efficient cleaning action and to avoid as much as possible the generation of airborne particles including mold, dirt and pollen that generate allergic reaction in many individuals, the vacuum cleaner 10 is equipped with a particularly efficient filtering system. Specifically, a partition 34 divides the cavity 16 into a first chamber 36 for receiving the dust bag 20 and a second chamber 38 for receiving the fan and motor assembly 18. The partition 34 includes a series of spaced-apart, overlying fingers 40, an underlying grating 41 and a cooperating flexible rubber gasket 42 for holding a filter pad 44.

Additionally, a final filtration compartment, generally designated by reference numeral 46 is provided in the main door 22. Specifically, the final filtration compartment 46 includes a recess 48 in the front face of the main door 22 for receiving a HEPA filter cartridge 50 of a type well known in the art. The final filtration compartment 46 is closed by an access door 52 that fits flush with the front face of the main door 22. Latch handle 54 allows the main door 22 to be opened in order to gain access to the first chamber 36 for the checking and/or changing of the dust bag 20. Latch handle 56 allows the access door 52 to be opened in order to gain access to the final filtration compartment 46 for the checking and/or changing of the filter cartridge 50. Each latch mechanism is of a type well known in the art.

The nozzle assembly 12 includes a nozzle 58 and preferably houses a rotating agitator brush 60 of a type well known in the art. The agitator brush 60 is, of course, rotatably driven by a shaft of the motor and fan assembly 18. Specifically, the motor and fan assembly 18 includes a drive shaft that is connected to the agitator brush 60 by means of a belt (not shown) in a manner well known in the art. Accordingly, the motor and fan assembly 18 and agitator brush 60 cooperate to brush and beat dirt from the nap of the carpet being cleaned and then draw dirt laden air into the dust bag 20.

More specifically, the motor and fan assembly 18 also generates a negative pressure or vacuum suction in the second chamber 38. This functions to draw air laden with loose dirt and dust through the nozzle 58 and the hose 62 into the dust bag 20. The dust bag 20, of course, serves to trap suspended dirt and dust particles inside while allowing the resulting relatively clean air to pass freely through the wall of the dust bag into the first chamber 36.

From there the air is drawn through the filter pad 44 into the second chamber 38. This serves to entrap and remove additional dirt and dust particles. From there the air is drawn into the fan of the fan and motor assembly 18 and exhausted through the port 64 into the inlet 66 formed in the wall of the recess 48 and in fluid communication with the final filtration compartment 46. As a result, the air is forced through the filter cartridge 50 and out the exhaust vent 68 in the face of the access door 52. Accordingly, it should be appreciated that dust and dirt are filtered from the air by the dust bag 20, filter pad 44 and filter cartridge 50. In addition, additional filtration may be provided if desired by positioning a sheet of filtering material, such as thin foam rubber, over the exhaust port 64 leading from the second chamber 38. Together such a filtering system functions to remove approximately 99.9% of all particles as small as 0.3 microns.

The real advantage of the present invention is the convenient positioning of the final filtration compartment 46. Specifically, many users often desire to change the final filter cartridge 50 in order to insure that the vacuum cleaner runs at peak operating efficiency while fully filtering undesirable particles and preventing them from being returned into the ambient air. Advantageously, the present vacuum cleaner 10 provides an access door 52 on the front face of the vacuum cleaner well above floor level where it may be easily found and readily seen to remind the user to check the filter cartridge 50. The access door 52 may also be easily and conveniently opened by means of the latch handle 56. The filter cartridge 50 may then be easily popped out from the recess 48 and replaced with a new filter cartridge. The access door 52 is then snapped back into position and the latch secured. All this may be accomplished without any significant stooping or bending and without having to lift or otherwise manipulate the main body of the vacuum cleaner. Thus, a filter change may be accomplished both conveniently and comfortably by the user.

It should also be appreciated that the filter cartridge 50 may be checked and/or changed without opening the main door 22 and in any way contacting the dust bag 20 or even opening the cavity 16 in which it is maintained to the ambient environment. Accordingly, an individual is not placed in contact with this relatively dusty and dirty enclosure and, therefore, an individual is not subjected to dust from this enclosure which might otherwise be inadvertently stirred into the air.

Additionally, it should be appreciated that the main door 22 may be easily removed from the vacuum cleaner 10 by means of the latch handle 54. Specifically, when the latch is opened with the handle 54 the main door 22 may be tilted, lifted and removed. Since the entire final filtration compartment 46 is carried by the main door 22, this means that the final filtration compartment may be easily removed with the main door and conveniently changed or cleaned, for example, with soap and water at the sink. This is an added convenience feature heretofore unavailable to the consumer.

In addition, the positioning of the final filtration compartment 46 well above and relatively remote from the motor and fan assembly 18 significantly reduces motor and fan noise during vacuum cleaner operation. Specifically, noise generated by the motor and fan assembly 18 is muffled and absorbed by components in the cavity 16 with little passing through the inlet 66, the filter cartridge 50 and the access door vents 68.

In summary, numerous benefits result from employing the concepts of the present invention. The vacuum cleaner 10 is provided with a more readily accessible final filtration compartment 46 that allows simple and efficient changing of the filter cartridge. Advantageously, this is achieved without even opening the cavity 16 containing the dust bag 20. This means that the filter cartridge 50 may be changed while avoiding communication with the dirty dust bag 20 and its immediately surrounding environment.

The foregoing description of a preferred embodiment of the invention has been presented for purposes of illustration and description. It is not intended to be exhaustive or to limit the invention to the precise form disclosed. Obvious modifications or variations are possible in light of the above teachings. Fox example, while the present invention is illustrated on an upright vacuum cleaner it is equally applicable to a canister model. Further, it should be appreciated that while a conventional dust bag is illustrated, other dust collectors of any type known in the art such as reuseable collection containers/vessels may be used. In addition, while an advanced HEPA filter cartridge 50 is described for purposes of final filtration, any other form of filter known to those skilled in the art could be used, including but not limited to foam and paper filter pads.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A vacuum cleaner, comprising:

a housing including a cavity;

a fan and motor assembly carried in said housing;

a dust collector held in said cavity;

a main door on said housing to gain access to said dust collector in said cavity; and a final filtration compartment carried on said main door, said final filtration compartment including an access door and a recess for holding a replaceable filter.

2. The vacuum cleaner of claim 1, wherein said access door is received in a front face of said main door.

3. The vacuum cleaner of claim 2, wherein said access door includes an exhaust vent providing communication between said final filtration compartment and the environment.

4. The vacuum cleaner of claim 3, wherein said final filtration compartment includes an inlet in fluid communication therewith to receive exhaust from said fan and motor assembly.

5. The vacuum cleaner of claim 1 further including a nozzle assembly in fluid communication with said fan and motor assembly.

6. A vacuum cleaner, comprising:

a nozzle assembly;

a handle pivotally connected to said nozzle assembly, said handle including a cavity;

a fan and motor assembly carried by said vacuum cleaner;

a dust bag held in said cavity;

a main door on said handle operable to gain access to said dust bag in said cavity; and a final filtration compartment carried on said main door.

* * * * *